US005284216A

United States Patent [19]

Brungs et al.

[11] Patent Number: 5,284,216

[45] Date of Patent: Feb. 8, 1994

[54] DOWN-THE-HOLE DRILL TOOL FOR DRILLING IN ADVANCE OF A CASING TUBE

[75] Inventors: Anders Brungs, Gävle; Jan-Gunnar Hedlund; Kjell-Ove Jansson, both of Sandviken; Bengt Asberg, Gävle, all of Sweden

[73] Assignee: Sandvik AB, Sandviken, Sweden

[21] Appl. No.: 920,556

[22] PCT Filed: Feb. 15, 1991

[86] PCT No.: PCT/SE91/00108

§ 371 Date: Oct. 13, 1992

§ 102(e) Date: Oct. 13, 1992

[87] PCT Pub. No.: WO91/12406

PCT Pub. Date: Aug. 22, 1991

[30] Foreign Application Priority Data

Feb. 19, 1990 [SE] Sweden ..... 9000582-8

[51] Int. Cl.[5] ..... E21B 10/00

[52] U.S. Cl. ..... 175/385

[58] Field of Search ..... 175/385–387, 175/389–391, 395, 407, 414

[56] References Cited

U.S. PATENT DOCUMENTS

| | | | |
|---|---|---|---|
| 3,367,430 | 2/1968 | Rowley | 175/385 |
| 3,416,616 | 12/1968 | Ahlgren | 175/258 |
| 4,440,244 | 4/1984 | Wiredal | 175/398 |
| 4,618,010 | 10/1986 | Falgout, Sr. et al. | 175/385 X |
| 4,763,737 | 8/1988 | Hellnick | 175/193 |

FOREIGN PATENT DOCUMENTS 2155540 5/1973 Fed. Rep. of Germany .

*Primary Examiner*—Thuy M. Bui

*Attorney, Agent, or Firm*—Burns, Doane, Swecker & Mathis

[57] ABSTRACT

A down-the-hole drill tool comprises a one-piece shaft and pilot bit. The shaft is adapted for connection to a down-the-hole hammer. A reamer and a guide body are detachably mounted to the one-piece shaft/pilot bit. The guide body has a downwardly facing shoulder for pushing a casing tube downwardly along with the tool.

8 Claims, 4 Drawing Sheets

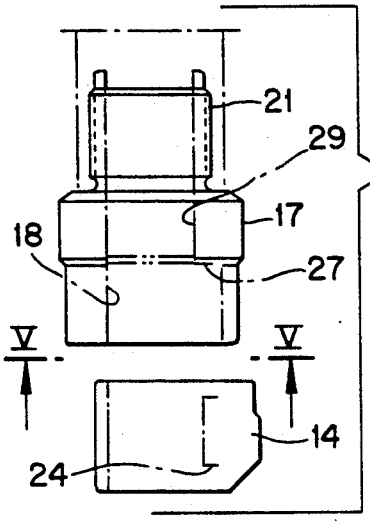
Fig. 1A
Fig. 2
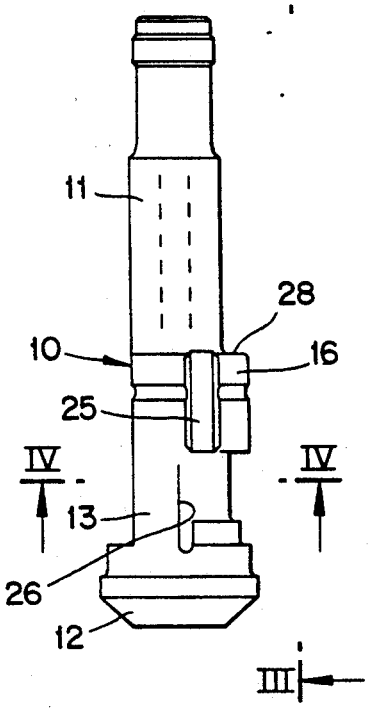
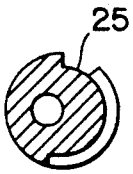
Fig. 4
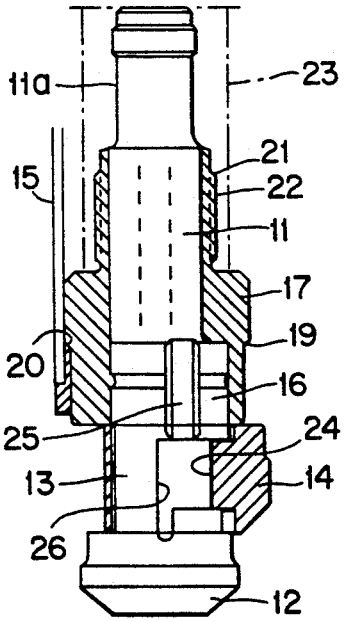
Fig. 1
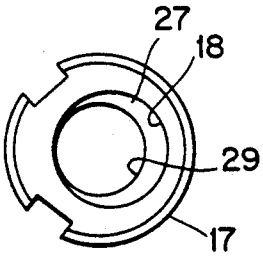
Fig. 5
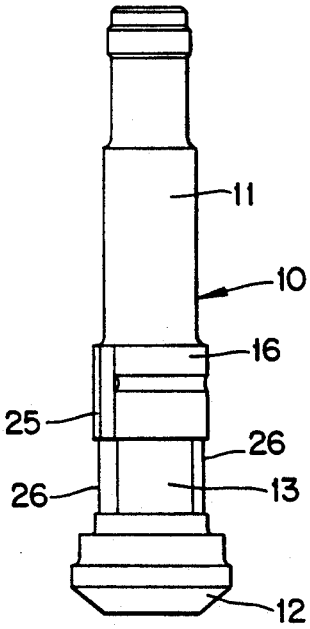
Fig. 3

Fig. 8
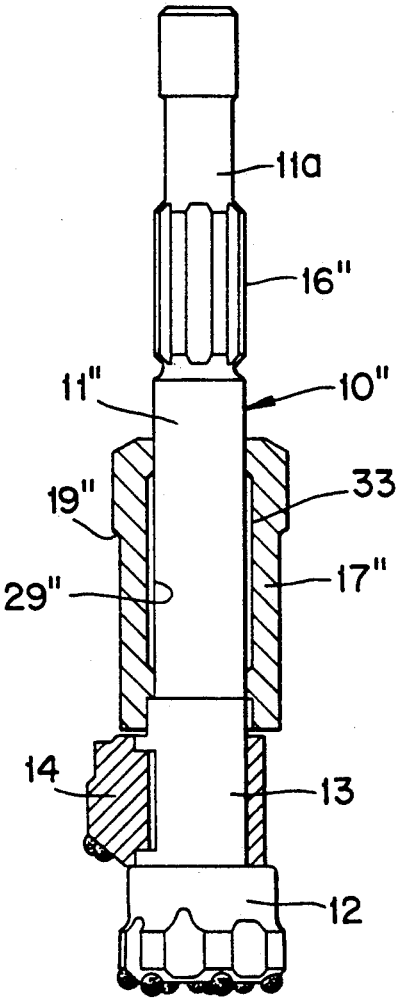
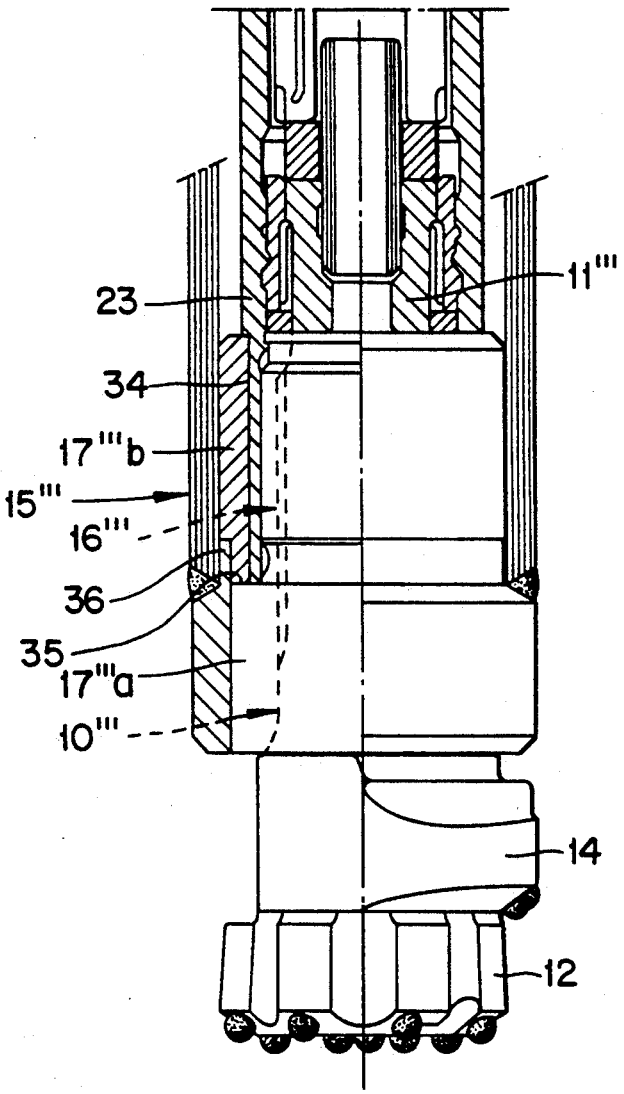
Fig. 9

Fig. 10
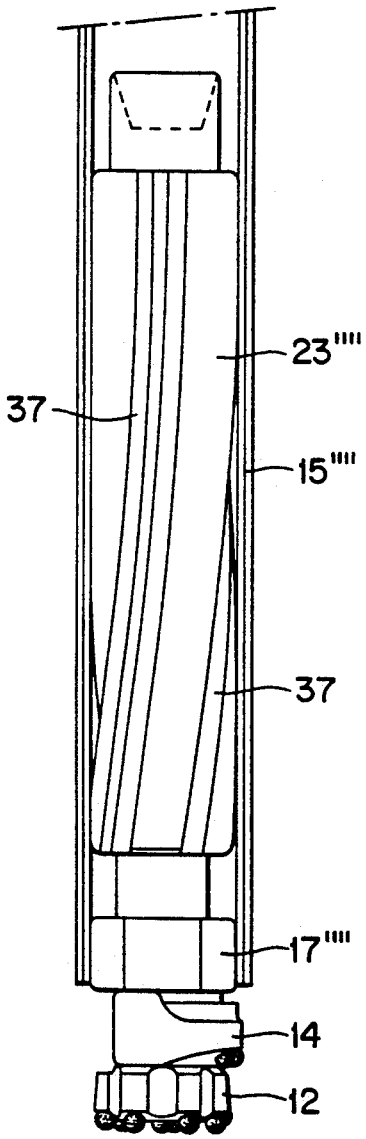
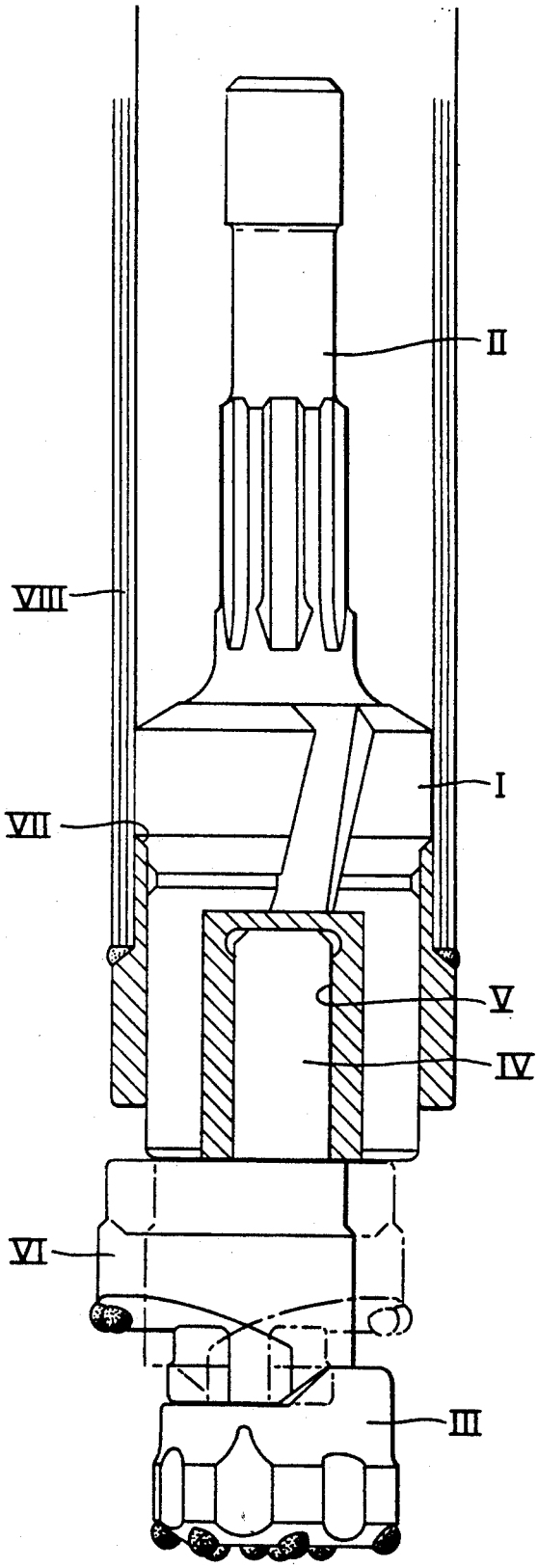
Fig. 11
PRIOR ART

DOWN-THE-HOLE DRILL TOOL FOR DRILLING IN ADVANCE OF A CASING TUBE

BACKGROUND OF THE INVENTION

This invention relates to a down-the-hole drill tool, said drill tool being adapted to drill a hole in advance of a trailing casing tube, said drill tool including a central pilot bit, a reamer means and a guide means for guiding said drill tool and said casing tube relative to one another, and a shaft that is adapted to be connected to a down-the-hole hammer. The invention also relates to a guide means and a one-piece unit being parts of the drill tool according to the present invention.

In known drill tools of the above-mentioned type the thread connection, e.g. between the guide means and the portion supporting the reamer, is the weak point Therefore it is an aim of the present invention to present a structural design of a drill tool of the type in question that avoids thread connections in portions of the drill tool that is subjected to high bending forces Also there is always a loss of energy in thread connections transferring impact energy.

BRIEF DESCRIPTION OF THE DRAWINGS

Below three embodiments of the drill tool according to the invention will be described, reference being made to the accompanying drawings where FIG. 0 discloses a schematic view of a prior art drill tool; FIG. 1 discloses a schematic, partly sectioned, view of an embodiment of the drill tool according to the invention, said FIG. 1A is an exploded view of the reamer and the guide body per se; FIG. 2 discloses a side view of the base member; FIG. 3 discloses a side view of the base member along III—III in FIG. 2; FIG. 4 discloses a section along IV—IV in FIG. 2; FIG. 5 discloses a view along V—V in FIG. 1A; FIG. 8 discloses a schematic, partly sectioned, side view of a further alternative embodiment of the drill tool according to the invention; FIG. 9 discloses a schematic, partly sectioned, side view of a further alternative embodiment of the drill tool according to the invention, FIG. 10 discloses a further alternative embodiment of the drill tool according to the invention, and FIG. 11 is a side elevational view of a prior art drill tool.

DESCRIPTION OF THE PREFERRED EMBODIMENTS OF THE INVENTION

Figure 6A:
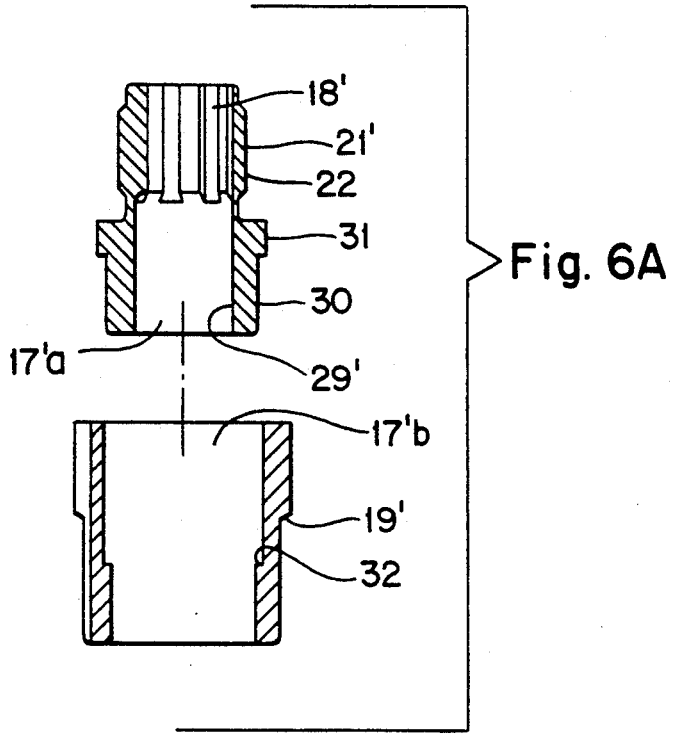
FIG. 6A is an exploded view of the parts making up the guide body of FIG. 6.

The prior art drill tool according to FIG. 0 includes guide body I having a shaft II integral with said guide body I and intended to be coupled to a DTH hammer. A pilot bit III is coupled to the guide body I by means of an externally threaded spigot IV that is received in an internally threaded bore V in the guide body I. A reamer VI is rotatably supported by an intermediate portion of the pilot bit III. The guide body I includes a downwardly facing shoulder VII which pushes a casing VIII downward.

The most frequent damage appearing on said prior art tool is a thread fracture on the upper part of the spigot IV. Therefore, as stated above the aim of the present invention is to delete said thread coupling between the shaft II and the pilot bit III.

The embodiment according to the present invention of the drill tool according to FIG. 1 includes a base member 10 disclosed separately in FIGS. 2 to 4. Said base member 10 comprises a shaft 11 and a pilot bit 12, said shaft 11 and pilot bit 12 constituting an integral unit.

The shaft 11 includes a bearing portion 13 that supports a reamer 14 having a varying wall thickness along its circumference. Said reamer 14 is rotatable a limited angle relative to the shaft 11. In FIG. 1 the reamer 14 is disclosed in its working position, i.e. the reamer 14 will generate a hole diameter that allows a casing tube 15 to advance downwards together with the drill tool. By rotating the drill tool in a direction opposite to its working direction the reamer 14 will rotate a limited angle relative to the bearing radially retracted portion 13 and assume a position that makes it possible to pull the drill tool up through the casing tube.

The shaft 11 includes a driving portion 16 that is intended to receive a guide body 17. The driving portion 16 is eccentrical to the rest of the shaft 11 and the guide body 17 has a mating eccentric recess 18, see FIG. 5. It is at once understood that when the guide body 17 is rotated the base member 10 will also be rotated by cooperation between the driving portion 16 and the recess 18 of the guide body 17.

The guide body 17 is provided with an external shoulder 19 that cooperates with an downward facing internal shoulder 20 on the casing tube 15. By this arrangement the casing tube 15 will be forced downwards when the drill tool is advancing downwards.

The guide body 17 has an upper sleeve portion 21 that has an internal diameter corresponding to the external diameter of the shaft 11. Said sleeve portion 21 is provided with an external thread 22 that engages an interior thread of a down-the-hole hammer 23, said hammer being indicated in FIG. 1 by chain dotted lines. The down-the-hole hammer 23 transfers rotation to the guide body 17 via the external thread 22. At its rear end the shaft 11 has a portion 11*a* having reduced diameter, said portion 11*a* being used to allow the shaft 11 to move axially a limited distance relative to the down-the-hole hammer 23.

In the upper part of FIG. 1 the mounting order of the reamer 14 and the guide body 17 is indicated. As is evident from FIG. 1 the reamer 14 is mounted first. The reamer 14 is provided with an internal driving tongue 24 that projects from the wall of the internal boring of the reamer 14. In order to make it possible for the reamer to slide by the eccentrical driving portion 16, said portion 16 is provided with an axially extending groove 25, see FIG. 3. Of course the depth of the groove 25 is adapted to the height of the driving tongue 24. As can be seen in FIG. 1 the groove 25 is offset laterally a certain distance relative the tongue 24 of the reamer 14 when the reamer 14 is in its working position. The reason therefore is that the groove 25 must not align axially with the tongue 24 when the reamer 14 is in its working position since in such a case the transfer of impact energy from the eccentric portion 16 to the tongue 24 of the reamer 14 is affected in a negative way.

In its mounted position the reamer 14 is overlapping the bearing portion 13 and as stated above the reamer 14 is rotatable a limited angle relative to the bearing portion 13. The angle that the reamer is allowed to rotate is defined by two axially extending shoulder surfaces 26 on the bearing portion 13

The guide body 17 is pushed on the shaft 11 subsequent to the reamer 14. As stated above the eccentric portion 16 is received in the recess 18 and in mounted position of the guide body 17 an upper internal abutment surface 27 of the guide body 17 contacts an upper external abutment surface 28 of the eccentric portion 16. Said abutment surfaces 27 and 28 have a generally radial extension.

The internal axial boring 29 of the guide body 17 has a diameter that mates with the external diameter of the shaft 11 above the eccentric portion 16. Preferably the boring 29 and the shaft 11 engage each other by slide fit.

Since the reamer 14 is normally worn out much faster than the pilot bit 12 it is necessary to exchange the reamer 14. In such a case the guide body 17 and the reamer 14 are dismounted in opposite order relative to what is described above.

Figure 7:
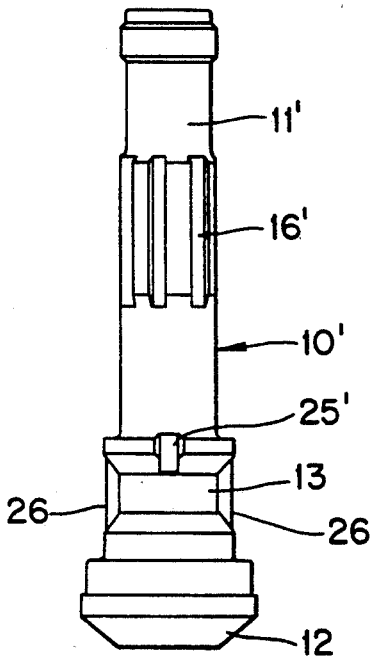
FIG. 7 discloses side view of the base member along VII—VII in FIG. 6.
Figure 6:
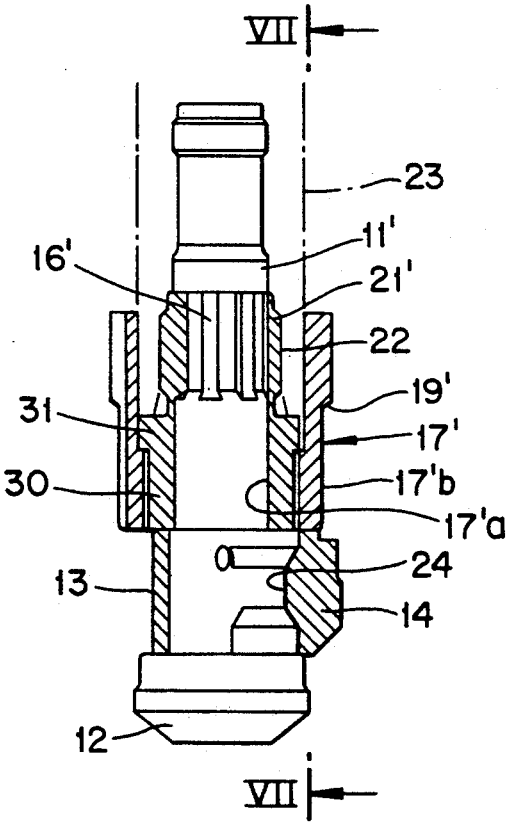
FIG. 6 discloses a schematic, partly sectioned, side view of an alternative embodiment of the drill tool according to the present invention.

The embodiment of the drill tool according to FIG. 6 includes a base member 10' disclosed separately in FIG. 7. Said base member comprises a shaft 11' and a pilot bit 12, said shaft 11' and pilot bit 12 constituting an integral unit. As in the embodiment described above the shaft 11' has a portion 11*a* having reduced diameter.

The shaft 11' includes a bearing portion 13 that supports a reamer 14, said portion 13 and said reamer 14 having principally the same design and function as in the embodiment described above. In the upper part of the bearing portion 13 a groove 25' is provided, said groove 25 is for the same reasons as described in connection with the embodiment according to FIGS. 1-5 being offset laterally relative to the tongue 24 of the reamer 14 when said reamer 14 is in its working position, see FIG. 6.

The shaft 11' includes a driving portion 16' in the shape of external axially extending first splines.

The guide body 17' has an inner part, the so called driver chuck, 17'*a* having an upper sleeve portion 21' that is provided with internal axially extending second splines 18' mating with the first splines 16' of the shaft 11'. It is at once understood that when the inner part 17'*a* of the guide body 17' is rotated the base member 10' will also be rotated by cooperation between the first and second splines 16' and 18', respectively.

The upper sleeve poortion 21' is also provided with an external thread 22 that engages an interior thread of a down-the-hole hammer 23, said hammer being indicated in FIG. 6 by chain dotted lines. Via said external thread 22 of the sleeve portion 21' the down-the-hole hammer 23 transfers rotation to said sleeve portion 21'.

The inner part 17'*a* has also a lower sleeve portion 30 that is provided with an external circumferential collar 31.

The guide body 17' also includes an outer part 17'*b* in the shape of a sleeve The lower portion of the part 17'*b* is provided with an internal shoulder portion 32 that contacts the collar 31 in mounted state of the inner and outer parts 17'*a* and 17'*b*, respectively. The outer part 17'*b* is also provided with an external shoulder 19' that engages the casing tube in a corresponding way as described in connection with the embodiment according to FIGS. 1-5.

When mounting the reamer 14 and the guide body 17' on the shaft 11' the reamer 14 is mounted first and the driving tongue 24 passes by the upper portion of the bearing portion 13 due to the groove 25'. Then the outer part 17'*b* is mounted and finally the inner part 17'*a*, said inner and outer parts 17'*a* and 17'*b* having slide fit relative to each other. This structural arrangement makes it possible for the outer part 17'*b* to slide downwards a small distance relative to the inner part 17'*a*. Such a displacement downwards of the outer part 17'*b* can prevent mud and cuttings from entering between the reamer 14 and the guide body 17'.

However, within the scope of the invention it is also possible to have the inner and outer parts 17'*a* and 17'*b* connected to each other by a thread connection or a welding connection.

The embodiment of the drill tool according to FIG. 8 includes a base member 10'' comprising a shaft 11'' and a pilot bit 12, said shaft 11'' and said pilot bit 12 constituting an integral unit. As in the embodiments described above the shaft 11'' has a portion 11*a* having reduced diameter.

The shaft 11'' includes a driving portion 16'' in the shape of external axially extending splines. Said driving portion 16'' cooperates with the internal splines of a bit sleeve mounted in a the down-the-hole hammer (not shown).

Between the driving portion 16'' and the pilot bit 12 the shaft 11'' is provided with an externally threaded portion 33 that engages the internal thread of a guide body 17'' in order to detachably mount the guide body 17'' on the shaft 11''.

The guide body 17'' has an external shoulder 19'' that cooperates with an internal shoulder of a casing tube (not shown) in order to drive down said casing tube.

Between the externally threaded portion 33 and the pilot bit 12 the shaft 11'' includes a bearing portion 13 that supports a reamer 14. The bearing portion 13 and the reamer 14 have principially the same design and function as in the embodiments described above. In the upper part of the bearing portion 13 an axial groove (not visible in FIG. 8) is provided to allow the tongue 24 of the reamer 14 to pass by the upper part of the bearing portion 13 when mounting or dismounting the reamer 14.

The embodiment according to FIG. 9 has a base member of essentially the same design as the embodiment according to FIGS. 6 and 7. The reamer 14 is of the same principal design as the reamer 14 of the previous embodiments.

The guide means includes a driver chuck 17'''*a* having an internal design to cooperate with the splines 16''' of the base member 10'''. Said driver chuck 17'''*a* is of standard design for DTH hammers A guide member 17'''*b* of the guide means is located in a recess 34 in a piston case 23 of the DTH hammer, the lower end of said guide member 17'''*b* abutting a shoulder 35 of the driver chuck 17'''*a*.

The guide member 17'''*b* is provided with an external, circumferential shoulder 36 cooperating with a casing shoe/casing tube assembly 15''', said external shoulder 36 forcing the casing shoe/casing tube assembly downwards together with the drill tool during drilling.

The embodiment according to FIG. 10 has a base member, a pilot bit 12 and a reamer 14 of principally the same design as the previous embodiments. The driver chuck 17''''*a* is octagonal in order to provide space for cuttings to pass between the driver chuck 17''''*a* and a casing tube 15''''.

The piston case 23'''' of the DTH hammer in FIG. 10 is provided with helical ribs 37 extending in the axial direction of said piston case 23''''. By such an arrangement the piston case 23'''' serves as a guiding for the casing tube 15''''.

In this connection it should be pointed out that in the embodiment according to FIG. 10 the drill tool/DTH hammer has no means for advancing the casing tube 15'''' downwards during drilling. To provide rotation and downwards displacement of the casing tube a so called double rotation drill rig is used, i.e. a rig implying separate rotation and downwards pressure upon the casing tube 15''''.

All embodiments described above refer to a type of down-the-hole drill tool having a reamer that is rotatable a limited angle relative to a bearing portion. However, the idea of this invention is also applicable on a down-the-hole drill tool of the type having the reamer and the pilot bit as an integral unit.

In the embodiments described above it is stated that the shaft and the pilot bit constitutes an integral unit. However, within the idea of the invention it is also possible to have an arrangement where the shaft and the pilot bit are in separate pieces but connected to each other by e.g. friction welding, i.e. the assembled unit has a design and function equal to an integral unit. For this reason the expression "... constituting a one-piece unit whereby said shaft and said pilot bit cannot be disconnected relative to one another ... " has been used in claim 1.

Also in other respects the present invention can be varied freely within the scope of the claims.

We claim:

1. A down-the-hole drill tool adapted to drill a hole in advance of a drilling casing tube, said drill tool including a central pilot bit, a reamer means and a guide means for guiding the drill tool and said casing tube relative to one another, said reamer means widening a plot hole drilled by said pilot bit to enable the casing tube to travel downwardly with said tool, and a shaft adapted to be connected to a down-the-hole hammer, the shaft and the pilot bit constituting a one-piece unit whereby said shaft and said pilot bit cannot be disconnected relative to one another.

2. Drill tool according to claim 1, wherein the reamer means is disposed above said pilot bit and constitutes a separate element that is detachably mounted on the shaft.

3. Drill tool according to claim 2, wherein the shaft is provided with an axially extending groove that mates with a driving tongue of the reamer means when mounting or dismounting said reamer means.

4. Drill tool according to claims 1, 2 or 3, wherein the guide means is detachably mounted on the shaft.

5. Drill tool according to claim 1, 2 or 3, further including a down-the-hole hammer means in which upper ends of the shaft and guide means extend.

6. Drill tool according to claim 1, wherein said guide means includes a downwardly facing shoulder for pushing the casing tube downwardly.

7. A one-piece unit included in a down-the-hole drill tool, said drill tool being adapted to drill a hole in advance of a trailing casing tube, said one-piece unit comprising a shaft and a pilot bit disposed at a lower end of the shaft such that the shaft and pilot bit cannot be disconnected relative to one another, the shaft including means for releasable connection with a reamer and a guide body of the drill tool.

8. A one-piece unit according to claim 7, wherein the shaft includes an axially extending groove for mating with a driving tongue of the reamer.

* * * * *